United States Patent [19]

Saklikar et al.

[11] 4,036,174

[45] July 19, 1977

[54] APPARATUS FOR THE APPLICATION OF COLORANT TO POLYMERIC SURFACE

[75] Inventors: Arvind R. Saklikar, Park Forest; Jack M. Van Eck, South Holland, both of Ill.

[73] Assignee: The Sherwin-Williams Company, Cleveland, Ohio

[21] Appl. No.: 671,200

[22] Filed: Mar. 29, 1976

Related U.S. Application Data

[62] Division of Ser. No. 546,582, Feb. 3, 1975.

[51] Int. Cl.[2] ..... B05C 5/02

[52] U.S. Cl. ..... 118/623; 118/657

[58] Field of Search ..... 118/623, 638; 427/11, 427/13, 18, 47, 127, 128, 129, 130, 131, 132

[56] References Cited

U.S. PATENT DOCUMENTS

| | | | |
|---|---|---|---|
| 2,786,440 | 3/1957 | Giaimo | 118/637 |
| 3,812,780 | 5/1974 | Borelli | 118/637 |
| 3,872,826 | 3/1975 | Hanson | 118/637 |

*Primary Examiner*—Henry S. Jaudon
*Attorney, Agent, or Firm*—Fay & Sharpe

[57] ABSTRACT

The apparatus for applying a stripe of colorant to a polymeric surface includes a spring biased, rotatably mounted circular magnet having a predetermined width. Non-magnetic walls extend radially outwardly from the magnet and are biased against the polymeric material. A retainer for holding a mixture of a ferro-magnetic carrier and a non-magnetic colorant is located within the magnetic field of the circular magnet. A rotatably supported roller on the side of the polymeric surface opposite the magnet supports the polymeric surface as it moves.

The process of applying a stripe of polymeric colorant to an embossed electrically uncharged polymeric surface including rotating a wheel-shaped magnet, attracting a mixture of ferro-magnetic material acting as a carrier for a polymeric colorant to the magnet and pressing the magnet with the mixture against the polymeric surface. The mixture is placed on the polymeric surface with sufficient pressure so that it is initially held on the polymeric surface by triboelectricity. The process also includes means of outlining the edges of the stripe comprising non-magnetic walls disposed on both sides of the rotating magnet. A protective coating is subsequently applied over the polymeric surface, the colorant.

7 Claims, 6 Drawing Figures

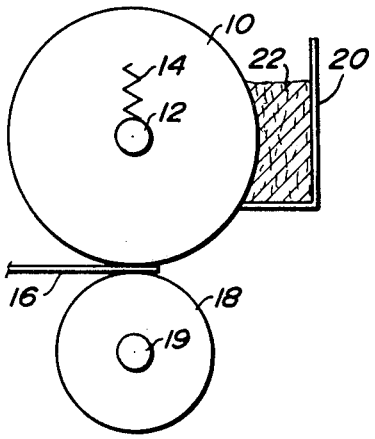
FIG. 3
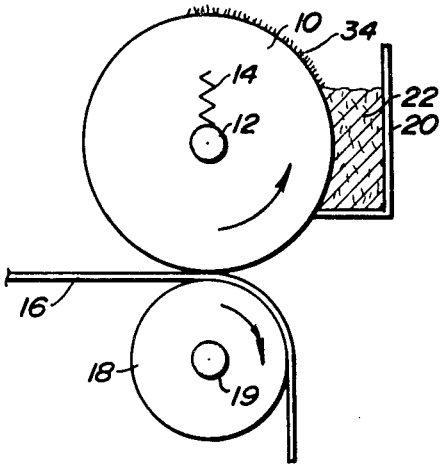
FIG. 4
FIG. 5
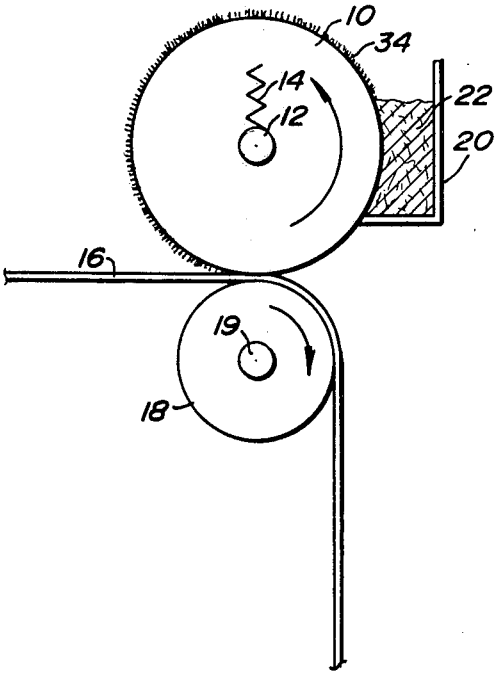
FIG. 6
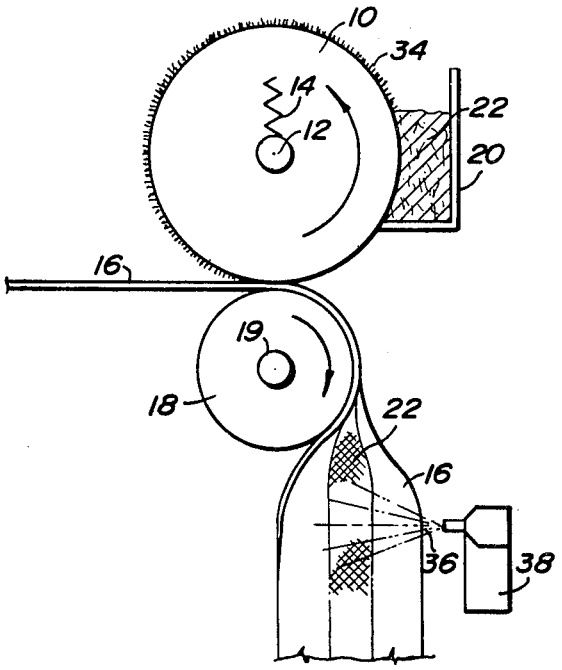

APPARATUS FOR THE APPLICATION OF COLORANT TO POLYMERIC SURFACE

This application is a division of application Ser. No. 546,582, filed Feb. 3, 1975.

BACKGROUND OF THE INVENTION

This invention relates to the application of colorant in a desired pattern to an embossed electrically uncharged polymeric surface.

It is often desirable to decorate items having polymeric surfaces, such as suitcases, automobile seats, and furniture upholstery with colorants. Where a surface is smooth, these are various methods to decorate it including spraying with spray masks, lamination, printing, and the like. However, if the polymeric surface is embossed, lamination, spraying with spray masks, and printing methods are not highly desirable. Lamination and spray with spray masks will not seal against the various peaks and valleys of an embossed surface and printing methods also have disadvantages. Electrostatic printing methods normally require that the substrate, in this case the polymeric surface, be electrostatically neutral or that a uniform field can be produced between the printing screen and the substrate surface. To obtain a uniform electrical field between an embossed surface and the printing screen is difficult because of the uneven surface. Moreover, when a non-uniform electrostatic field is established between the substrate and the printing screen, the uneven surface may cause the designs to have feathered edges. Thus, designs are not as attractive and distinct as desired.

The prior art, e.g., U.S. Pat. No. 3,058,444 uses a rotatably mounted magnetic roller to deposit a mixture of magnetic powder and toner to an electrophotographically formed electrostatic latent image. The necessity of charging the surface and application of electrophotographic coating to the surface requires specialized equipment with its appurtenant cost. Moreover, variations in the amount of the electrostatic charge in the latent image could vary the concentration of the deposited mixture and/or cause a feathered effect at the edge of a design. Coatings have been applied to embossed surfaces but generally an adhesive method is used, e.g., see U.S. Pat. No. 3,616,135.

The present invention has the distinct advantage of not requiring the substrate to be electrically charged. That is, the material which has a polymeric surface is electrically uncharged although alternately it may be charged if desired. The theory on which the present invention is based is that if a colorant made of a polymeric material is pressed against another polymeric surface, the friction itself will cause an electrostatic attraction known as a triboelectric effect. This triboelectric effect at least temporarily holds the colorant against the polymeric surface until it can be subsequently coated with a coating of some type such as hydroxy functional acrylic with urethane and 1,6 diacrylate.

Another apsect of this invention is the use of a roller magnet bounded by generally non-magnetic walls on both sides thereof which extend radially outwardly so that the magnetic carrier and polymeric colorant is attracted and distributed in a straight line. The wheel-shaped magnet is biased against the polymeric surface so that it presses the mixture against the surface and deposits it thereon. The walls prevent any feathering of the stripe or other desired design.

Different methods for holding a polymeric material in position on the polymeric surface are the applications of heat and resins. However, if heat and resins are not used in precise amounts, they will distort the polymeric surface. The subject invention has the advantage of less risk of damage to the surface. The coating is simply applied and permitted to dry by dehydration or by application of ultraviolet light.

SUMMARY OF THE INVENTION

The apparatus includes a magnet having substantially rounded or circular surface, biasing means for holding the magnet against the polymeric surface, a retainer in the field of the magnet for holding a mixture of magnetic powder and a colorant so that the magnet will attract the mixture and deposit it on the polymeric surface and means for providing relative movement between the magnet and the polymeric surface.

The process of applying a design of colorant to an electrically uncharged polymeric surface including placing a magnet in contact with a mixture of ferromagnetic powder and a non-magnetic colorant in order that some of the mixture may be magnetically affixed to the magnet and then pressing the magnet against the polymeric surface so that at least some of the colorant will be transferred to and held on the surface by means of triboelectricity.

BRIEF DESCRIPTION OF THE DRAWINGS

FIGS. 3 through 6 represents the process of this invention and are schematic representations of a roller magnet depositing colorant on a polymeric material.

DETAILED DESCRIPTION OF THE DRAWINGS

Figure 1:
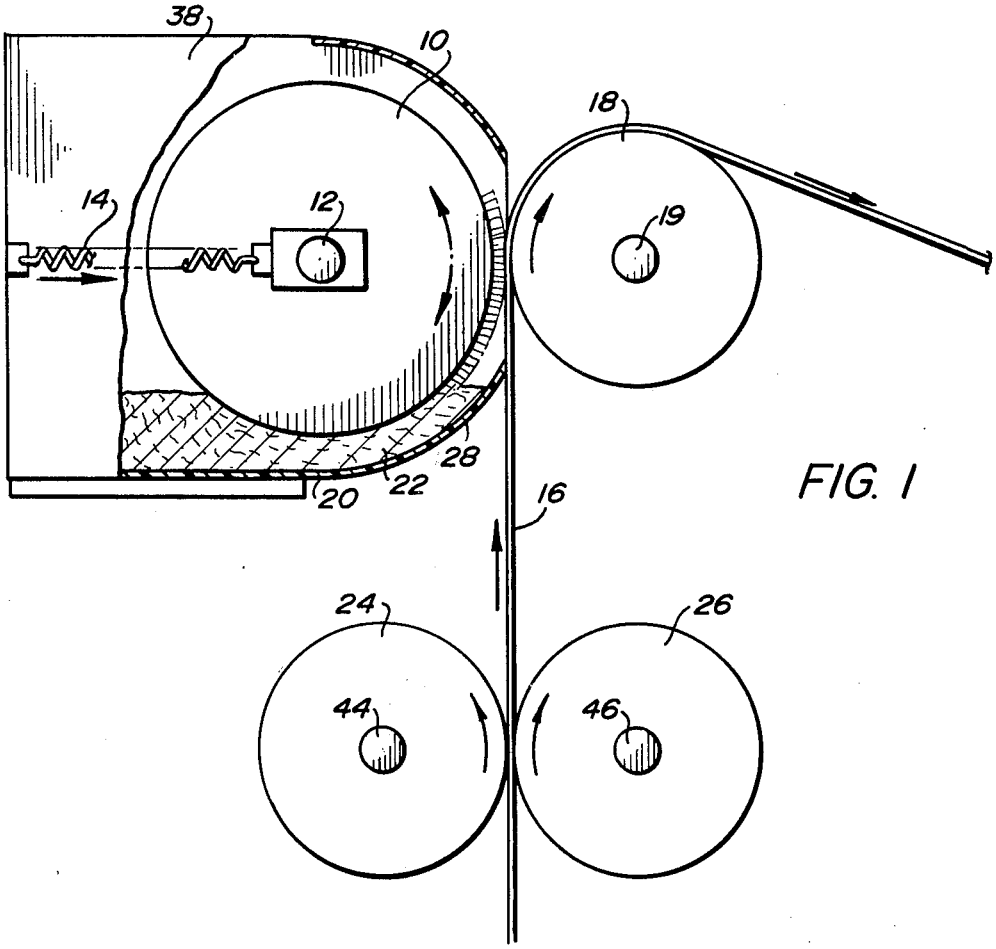
FIG. 1 is a schematic side elevation view in partial cross-section of the apparatus of this invention.
Figure 2:
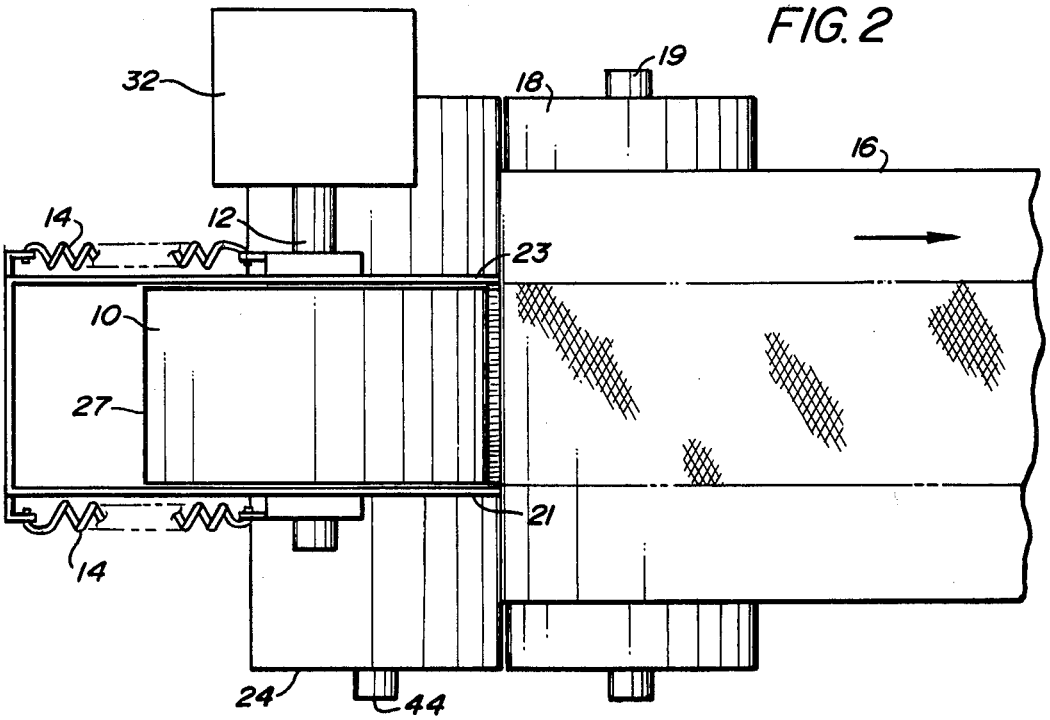
FIG. 2 is a plan view in partial cross-section of a schematic representation of this same apparatus.

The apparatus of this invention is illustrated in FIGS. 1 and 2. A roller magnet 10 is provided having a generally circular configuration and is rotatably journaled on a shaft 12. Although it is contemplated that the roller magnet 10 will be comprised of a permanent-type magnet, an electromagnet could also be employed particularly where frequent color changes are made. Springs 14 or other biasing means are suitably attached to a stationary support and the roller magnet 10 in a manner to continuously bias the roller magnet against a polymeric surface 16. The roller magnet 10 is preferably biased toward the polymeric surface with a pressure of about 0.6 pounds/inch$^2$ and is rotated at about 27 rpm by means described hereinafter. The roller magnet 10 has a preferred diameter of approximately one inch. Variations in the preferred pressure, size and rotational speed are permissible. The polymeric surface is supported on one side by means of a rotatably mounted support roller 18 journaled on a shaft 19.

A bin or hopper 20 is located within the magnetic field created by the roller magnet 10 with a mixture 22 comprised of ferro-magnetic material and a polymeric colorant contained within the bin. The hopper 20 has walls 21 and 23 extending outwardly therefrom which form closely spaced dams or sides for the rotatably mounted roller magnet 10. These walls act to contain the colorant and ferro-magnetic material mixture 22 along a very precise predetermined path. Accordingly, distortion such as feathering and an uneven distribution of the mixture can be avoided.

The ferro-magnetic material of the mixture 22 is generally comprised of iron particles having a size distribution below 100 microns. Other carrier materials that may be utilized are $Fe_2O_3$ and generally any iron compound, iron alloy powder or other material that can be magnetized. The mixture 22 contains about 98% by weight of iron powder and 2% by weight of colorant although these proportions may vary.

The polymeric colorant used in the preferred arrangement of this invention is a commercially available Xerox 3600/7200 toner powder. This size of the particles used is about 16 microns although a range below 23 microns, and perhaps more, is permissible. It is desirable that the size be kept as uniform as possible during an application. It is also preferable to use a small particle since the printing quality is improved thereby. Other polymeric colorants which may be utilized are insulating powders having sizes below about 80 microns, such as epoxy, polyester, acrylic, polystyrene, etc.

In the preferred environment in which the subject invention is contemplated for use, the polymeric surface on which the design is placed is a vinyl coated fabric. It is anticipated that surfaces having a conductivity below $10^{-7}$ ohm-cm, such as paper and polymeric films, may also be so coated. To this end, a pair of rollers 24 and 26 stabilize the surface 16 between the magnetic roller 10 and the support roller 18. It should be understood, however, that the roller magnet 10 could be moved instead of the polymeric material to generally obtain the same result and that the apparatus could be made entirely portable. The polymeric surface 16 is moved merely as a matter of convenience and expediency. The width 27 of the roller magnet 10 acts in combination with the side walls 21 and 23 of the hopper 20 to determine the shape and size of the design. Thus, while this invention is described with reference to a stripe as placed on the surface 16, it is fully anticipated that other designs could be made utilizing this invention. In this regard, it would only be necessary to change the shape of either the magnet and/or the walls of the hopper 20 in order to vary the design.

A motor 32 drives the shaft 12 in order to rotate the roller magnet 10 at a desired speed. The rollers 24 and 26 are journaled on shafts or axles 44 and 46, respectively. The directions of rotation of these rollers, as well as roller 18, are designated by the arrows shown thereon in the Figures.

It is a distinct advantage of this invention that it can be utilized with respect to an embossed polymeric surface 16. That is, the walls 21 and 23 act to contain the material and are pressed against the material so that, in spite of any variations in the surface characteristics, none of the mixture excapes from the desired predetermined path.

If desirable, the polymeric surface 16 may be electromagnetically charged although it is not necessary. However, the use of a magnetic roller in conjunction with non-magnetic walls to shape the design with an electrostatically charged surface is included within the scope of this invention.

The process of this invention is illustrated in FIGS. 3 through 6. The apparatus is illustrated schematically somewhat differently from FIGS. 1 and 2 in order to show in detail the steps involved. Initially in FIG. 3, the roller magnet 10 is in contact with the mixture 22 but has not yet begun to move. As rotation begins and as shown in FIG. 4, the mixture 22 has been attracted to the roller magnet 10 and forms a brush-like effect generally designated 34. As the roller magnet 10 continues to rotate as shown in FIGS 5 and 6, the colorant is deposited in a striped configuration on the polymeric surface 16 where it is held due to the triboelectric effect. As the polymeric surface 16 progresses between magnet 10 and roller 18, it is subsequently covered with a coating 36 of hydroxy functional acrylic with urethane l,6 hexanedial diacrylate by means of any convenient spray apparatus 38 or some similar compound. It has been found that a coating of this type which dries due to dehydration or with ultraviolet light is preferable to either heating or a resin-type sealant. Other means of permanently affixing the colorant to the substrate include pressure fusion, solvent vapor fusion and infrared and heat fusion. As explained above, however, these alternatives are not as desirable for vinyl substrates.

While this invention has been described with reference to a thin polymeric surface 16, it should be appreciated that use of the invention is in no way limited to such a surface. It is understood that variations of this invention will be obvious to those skilled in the art and such variations should be interpreted as being included within the scope of this invention.

The invention claimed is:

1. Apparatus for applying a design of polymeric colorant to a polymeric surface, said apparatus comprising:

a cylindrical roller magnet mounted for rotation about its longitudinal axis including a cylindrical outer surface and means for continuously rotating said roller magnet between a colorant reservior and a colorant application zone disposed in operative communication with a work path;

non-magnetic side walls extending radially outward at least from said roller magnet outer surface to said application zone for controlling the width of colorant applied to said surface along said work path;

means for positioning said polymeric surface along said work path in operative communications with said application zone;

means for continuously urging said roller magnet toward said work path into positive contact with said polymeric surface;

a reservoir for holding a supply of a magnetic powder and polymeric colorant mixture in close proximity to at least the magnet outer surface in a manner such that at least said outer surface will attract the mixture during rotation of said roller magnet and carry said mixture toward said application zone; and, means for moving said roller magnet and polymeric surface relative to each other along said work path whereby said magnet will continuously attract said mixture thereto during rotation thereof and will continuously carry said mixture to said application zone where at least said colorant will be applied to said polymeric surface and at least temporarily retained thereon by a triboelectric effect caused by said roller magnet being urged into contact with said polymeric surface along said work path.

2. The apparatus of claim 1 which further includes a rotatably supported roller on the side of the polymeric surface opposite from the roller magnet for supporting the polymeric material while the roller magnet deposits the colorant to the polymeric surface.

3. The apparatus of claim 1 wherein the roller magnet has a diameter of approximately one inch, the polymeric surface has conductivity below about $10^{-7}$ ohm-cm and the polymeric colorant is comprised of particles below about 23 microns in size.

4. The apparatus of claim 1 wherein the magnetic powder includes iron particles having a size distribution below about 100 microns and the reservoir for holding the mixture of magnetic powder and polymeric colorant is within the magnetic field of the roller magnet.

5. The apparatus of claim 1 wherein the urging means comprises a spring biasing means disposed adjacent each end of the roller magnet for forcing the magnet toward the polymeric surface and into contact therewith for depositing the colorant thereon by said triboelectric effect.

6. The apparatus of claim 1 wherein said reservoir surrounds a portion of said cylindrical roller magnet and said non-magnetic side walls are affixed to and extend outwardly therefrom generally radially of said roller magnet.

7. The apparatus as defined in claim 6 wherein said polymeric surface is continuously moved relative to said roller magnet along the work path.

* * * * *